US005284731A

United States Patent [19]

Tyagi et al.

[11] Patent Number: 5,284,731

[45] Date of Patent: Feb. 8, 1994

[54] METHOD OF TRANSFER OF SMALL ELECTROSTATOGRAPHIC TONER PARTICLES

[75] Inventors: Dinesh Tyagi, Fairport; Alec N. Mutz, Rochester, both of N.Y.

[73] Assignee: Eastman Kodak Company, Rochester, N.Y.

[21] Appl. No.: 890,892

[22] Filed: May 29, 1992

[51] Int. Cl.[5] ..... G03G 13/14

[52] U.S. Cl. ..... 430/126

[58] Field of Search ..... 430/126

[56] References Cited

U.S. PATENT DOCUMENTS 3,592,642 7/1971 Kaupp .
3,781,105 12/1973 Meagher .
3,837,741 9/1974 Spencer .
3,850,519 11/1974 Weikel, Jr. .
4,341,455 7/1982 Fedder .
4,430,412 2/1984 Miwa et al. .
4,439,462 3/1984 Tarumi et al. .
4,559,509 12/1985 Mayer .
4,737,433 4/1988 Rimai et al. .
4,927,727 5/1990 Rimai et al. .
4,968,578 11/1990 Light et al. .
5,010,370 4/1991 Araya et al. .
5,037,718 8/1991 Light et al. .
5,038,178 8/1991 Hosoya et al. .
5,043,242 8/1991 Light et al. .
5,045,424 9/1991 Rimai et al. .

*Primary Examiner*—John Kight, III
*Assistant Examiner*—T. Mosley
*Attorney, Agent, or Firm*—Willard G. Montgomery

[57] ABSTRACT

A method is provided for transferring electrostatically charged thermoplastic toner particles having a particle size less than about 8 micrometers from an element to a receiver within a transfer zone. The receiver is heated and contacted with the electrostatically charged toner particles on the element at a temperature sufficient to adhere the particles to one another at their points of contact, but insufficient to cause the toner particles to flow into a single mass. An electric field tending to force the charged toner particles toward the receiver is simultaneously applied to the transfer zone. The receiver is subsequently separated from the element.

19 Claims, 1 Drawing Sheet

METHOD OF TRANSFER OF SMALL ELECTROSTATOGRAPHIC TONER PARTICLES

FIELD OF THE INVENTION

This invention relates to a method of transferring small electrostatographic toner particles from an element to a receiver. In particular, it relates to such a method where the transfer of the small toner particles is electrostatically and thermally assisted.

BACKGROUND OF THE INVENTION

A conventional electrostatographic copying process involves the formation of a latent electrostatic image on an element, typically an insulating substrate such as a photoconductor. Charged toner particles are then applied to the electrostatic image, where they adhere in proportion to the magnitude of the electrostatic potential difference between the toner particles and the charge on the image. The toner particles that form the developed image are then transferred to a receiver, usually electrostatically, by means of an electrostatic bias between the element and the receiver.

This conventional process works well with large toner particles. However, various difficulties arise when conventional electrostatic transfer techniques are used with smaller toner particles. Such particles are necessary to produce copies of very high resolution, because the granularity in an electrophotographic image is inversely proportional to the diameter of the toner particles used. As the size of the toner particles falls below about 8 micrometers, the surface forces holding the toner particles to the element tend to dominate over the electrostatic force that can be applied to the particles to assist their transfer to the receiver. Image quality, therefore, is reduced because less toner transfers. Moreover, those particles which do transfer frequently fail to transfer to positions on the receiver that are directly opposite their positions on the element. This "scattering" of toner particles due to repulsive coulombic forces lowers the resolution of the transferred image and increases graininess and mottle.

U S. Pat. No. 4,927,727 to Rimai et al. describes a thermally assisted method of transferring small toner particles which is designed to overcome the problems associated with electrostatic transfer. In this method, the receiver is heated, typically to about 60° to 90° C., and is pressed against the toner particles on an element. The heated receiver sinters the toner particles, causing them to stick to each other and to the receiver, thereby effecting the transfer of the toner from the element to the receiver. No electrostatic force is exerted on the toner particles during transfer. The temperature to which the receiver is heated is insufficient to melt or fix the toner particles, but is sufficient to fuse particles to each other at their points of contact.

To aid in transferring all of the toner particles from the element to the receiver, it is advantageous to coat the receiving surface of the receiver with a thermoplastic polymer. During transfer the toner particles adhere to or become partially embedded in the thermoplastic coating and thereby are more completely removed from the element. A further improvement in the procedure is to coat the thermoplastic polymer layer on the receiver with a low surface energy release agent. These improvements and preferred materials for the thermoplastic layer and the release agent are disclosed in more detail in U.S. Pat. No. 4,968,578 to Rimai et al., which is incorporated herein by reference.

While a release agent can advantageously be coated on the thermoplastic layer of the receiver sheet, other techniques can also be used to improve the transfer efficiency. For example, when the binder resin for the photoconductor and the thermoplastic polymer layer of the receiver are appropriately selected with respect to their compositions and surface energies, a release agent is not necessary. These improvements and examples of preferred materials are disclosed in U.S. Pat. Nos. 5,037,718 to Light et al., 5,043,242 to Light et al., and 5,045,424 to Rimai et al., which are incorporated herein by reference.

Even with the new thermally assisted transfer process disclosed in the cited patents, in each case some type of coated receiver is necessary to achieve the desired transfer efficiency, thereby increasing the cost of making high resolution copies using very small toner particles.

Accordingly, it would be desirable to provide a method for transferring very small toner particles from an element to a receiver which achieves complete or nearly complete toner transfer (and, thus, yields high quality, high resolution images) without the added costs, and complications, associated with special overcoat receivers. Additionally, it would be desirable to provide a small particle toner transfer method which achieves improved transfer efficiency when an overcoat receiver is used.

SUMMARY OF THE INVENTION

It has now been found that the electrostatic charge on toner particles which remains following the formation of the latent electrostatic image on the surface of an element does not disappear immediately when the small toner particles are subjected to thermal energy in a thermally assisted transfer process. This residual charge may be used to improve the toner transfer efficiency of the thermal assist process, with or without the use of a special overcoat receiver, by applying an electric field to assist the transfer of toner particles.

In accordance with this invention, there is provided a method of transferring electrostatically charged thermoplastic toner particles having a particle size of less than about 8 micrometers from an element having a surface to a receiver within a transfer zone, comprising:

heating the receiver;

contacting the heated receiver with the toner particles at a temperature sufficient to adhere the toner particles to one another at points of contact between the toner particles, but insufficient to cause the toner particles to flow into a single mass;

simultaneously establishing an electric field within the transfer zone tending to force the toner particles toward the receiver; and thereafter separating the receiver from the element.

The method of the invention results in the transfer of all, or virtually all, of the toner particles from the element to the receiver, even when toner particles having a very small particle size, i.e. less than about 5 micrometers, are used, and even when no overcoat receiver is used. Images of very high resolution and high quality are thus obtained. This is surprising because, as described above, the surface forces exerted on very small toner particles by the element surface have been difficult to overcome electrostatically, and the electrostatic forces exerted on the very fine charged particles have been known to cause particle scattering, leading to a reduction in image quality.

Aside from the fact that high image quality is achieved through the method of the invention, without necessarily having to use the coated receivers which, in the past, have been employed to improve the transfer efficiency of the thermally-assisted transfer process, the method of the invention has several other significant advantages. It is possible using the electrostatically assisted thermal transfer method of the invention, to lower the temperature at which the conventional thermally assisted transfer process is carried out. The range of temperatures at which the desired transfer is achieved is thereby broadened. The toner particles on the element may also be contacted with the receiver at a reduced pressure, reducing the likelihood of retention of "ghost images" on the image bearing element. These reductions in temperature and pressure also result in reduced operating costs and less degradation of the element and pressure roller typically used to contact the receiver to the toned image. System cleaning requirements may be reduced. Finally, improved color balance may be achieved in color prints.

DETAILED DESCRIPTION OF THE INVENTION

Figure 1:
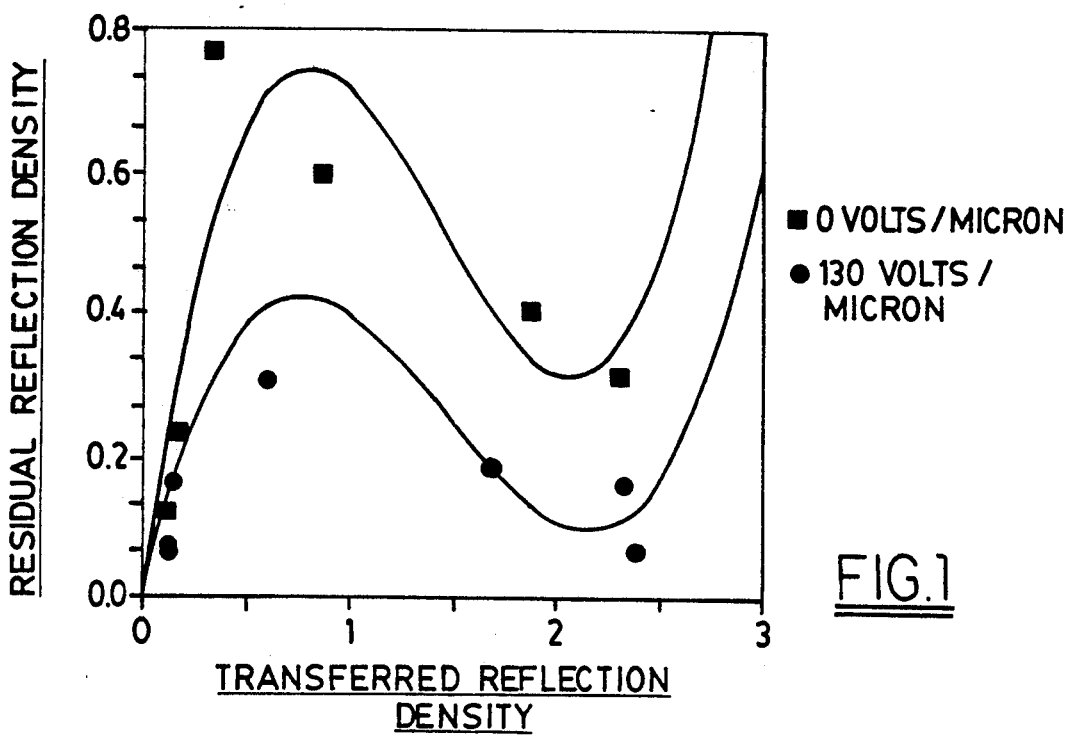
FIG. 1 is a graph of reflection density of residual (untransferred) toner as a function of reflection density of transferred toner in the absence and presence of an electric field using a non-low surface energy photoconductor.

By the method of the present invention, electrostatically charged thermoplastic toner particles having a particle size less than about 8 micrometers are transferred from an element to a receiver within a transfer zone. By "transfer zone" we mean the space between the element surface and the receiver through which toner particles travel from their respective positions on the element surface to directly opposite positions on the receiver.

The receiver is heated, but not heated sufficiently to melt the particles. Merely causing the toner particles to adhere to each other at their points of contact is adequate to accomplish a complete, or nearly complete, transfer of the particles. By "points of contact" we mean localized regions on the individual toner particle surfaces which are in contact either with one another or with the surface upon which such a particle is transferred or deposited. The toner is not fixed during transfer, but instead is fixed at a separate location away from the element. In this manner, the higher temperatures required for fixing the toner do not negatively affect or damage the element. Since the heat required to merely adhere the toner particles at their points of contact is much lower than the heat needed to fix the toner, the element is not damaged by high temperatures during transfer.

The term "adhere" or "adherence" as used herein in relation to toner particles employed in the practice of the present invention has reference to bonding or fusion that is thermally achieved at locations of contact existing either between adjacent toner particles or between toner particles and an adjacent surface. The term "adhere" is distinguished for present purposes from a term such as "melts", "melting", "melt", "melt fusion" or "heat fusion." In heat fusion, in response to sufficiently applied thermal energy, toner particles tend to lose their discrete individual identities and melt and blend together into a localized mass, as when a toner powder is heat fused and thereby bonded or fixed to a receiver.

In the method of this invention, the receiver is preheated to a temperature such that the temperature of the receiver during transfer will be adequate to fuse the toner particles at their points of contact but will not be high enough to melt the toner particles, or to cause contacting particles to coalesce or flow together into a single mass. The temperature range necessary to achieve that result depends upon the time a receiver resides in the nip and the heat capacity of the receiver. In most cases the result can be achieved if the temperature of the receiver immediately after the receiver contacts the element is below the $T_g$ of the toner binder but above a temperature that is 20 degrees below that $T_g$. However, receiver temperatures up to 40° C. above the $T_g$ of the toner binder are tolerable when nip time is small or the heat capacity of the receiver is low. Although either side of the receiver can be heated, it is preferable to heat only the front surface of the receiver, that is, the surface of the receiver that will contact the toner particles, as this is more energy efficient, it is easier to control the temperature of that surface when the heat does not have to pass through the receiver, and it usually avoids damage to the receiver. Such heating can be accomplished by any suitable means, such as radiant heat in an oven or contacting the receiver with a heated roller or a hot shoe.

The preheating of the receiver must be accomplished before the heated portion of the receiver contacts the element because, if the receiver is heated only in the nip, its temperature may fluctuate over a wide range and its temperature cannot easily be kept within the range required for the successful practice of this invention. Thus, if the backup roller, which presses the receiver against the element, is used to heat the receiver, the receiver must be wrapped around the backup roller sufficiently so that the receiver is heated to the proper temperature before it enters the nip. The backup roller is preferably not the sole source of heat used to effect the transfer, however, because the backup roller heats the back of the receiver, which means the heat must pass through the receiver to reach the toner. As a result, depending upon the receiver used, the process speed, and the ambient temperature, at times too much heat will pass through the receiver and it will melt the toner, while at other times insufficient heat will pass through the receiver and the toner will not transfer well. Thus, while the backup roller can be heated if desired, it is preferable to use an unheated backup roller. Despite these shortcomings, however, the method of the invention may conveniently be practiced with a heated backup roller.

As described above, the transfer of small toner particles from an element to a receiver by the method of the invention is assisted by the application of an electric field in the transfer zone between the element and the receiver. The electric field is applied to exert an electrical force on the charged particles which tends to force them from the element to the receiver.

The electric transfer field may be established by techniques well-known in the art. In particular, a pressure roller or platen used to aid the transfer of toner particles as described above (a transfer member) may be electrically biased as described, for example, in U.S. Pat. Nos. 3,781,105 to Meagher and 3,837,741 to Spencer, which are hereby incorporated by reference. As described in these patents, the transfer member is used for electrically cooperating with a photoconductive plate when brought into contact therewith to attract toner particles bearing an electrostatic charge on the plate toward the member. Transfer is accomplished as in the prior art by feeding a sheet of transfer material into the nip region formed by the surface of the transfer member and surface of a photoconductive insulating material bearing a developed image and imposing a potential on the transfer member sufficient to cause the transfer of the toner from the photoconductive insulating material to the transfer material. In practice, any source of electrical power connected to the central conductive core of the transfer member and capable of placing the transfer member at potential sufficient to attract toner images from the photoconductive insulating surface toward the member may be employed.

A more complete discussion of the principles and configurations involved in bias member transfer may be found in U.S. Pat. Nos. 2,951,443, 3,620,616, 3,633,543, 3,781,105 and 3,708,482, which are hereby incorporated by reference, and in Shaffert, *Electrophotography* 2d Ed. pp. 52–53 (Focal Press Limited 1975).

Alternatively, a potential may be imposed on a roller or other member pressed against the side or face of a toner-bearing substrate (such as an element) opposite the surface on which toner particles are carried, such that the charged toner particles are, in effect, repelled or "pushed" from the substrate toward the receiver through the transfer zone. This method of establishing the desired electric field is particularly useful when an intermediate transfer member is used, as described, for example, in U.S. Pat. No. 4,430,412, to Miwa et al., which is hereby incorporated by reference.

An electric field having a field strength of 80 to 150 volts/micron is useful in the practice of the present method. Particularly preferred are field strengths of 90 to 140 volts/micron.

As with any thermally assisted method of transfer, it has been found that pressure aids in the transfer of the toner to the receiver, and an average nip pressure of about 2 to about 40 pounds/linear inch (pli) is preferred, as when a roller nip region is used to apply such pressures, or when such pressures are applied by a platen or equivalent. Lower pressures may result in less toner being transferred and higher pressures may damage the element and can cause slippage between the element and the receiver, thereby degrading the image. Particularly preferred are contact pressures between 8 and 30 pli.

As a result of the combination of contact time and temperature, applied pressure, and electrostatic attraction, the toner particles are transferred from the element surface to the adjacent receiver. In all cases, the applied contacting pressure is exerted against the outside face of the receiver opposite the side facing the element surface on which the toner particles are carried. On the element side of the transfer zone, the applied contacting pressure is exerted against the side or face of the element opposite to the element surface on which the toner particles are carried.

The toner must not be fixed during transfer but must be fixed instead at a separate location that is not in contact with the element. In this way, the element is not exposed to high temperatures and the toner is not fused to the element. Also, the use of the lower temperatures during transfer means that the transfer process can be much faster, with 40 meters/minute or more being feasible.

Typically, after transfer of the toner particles from the element to the receiver and subsequent separation of the receiver from the element, the developed toner image is heated to a temperature sufficient to fuse it to the receiver.

Halftone, continuous tone, and line and text images can be transferred with equal facility using the process of this invention.

Toners useful in the practice of this invention are dry toners having a particle size of less than 8 micrometers, and preferably less than 5 micrometers. The term "particle size," or the term "size" in reference to the term "particles," means the mean volume weighted diameter as measured by conventional diameter measuring devices, such as a Coulter Multisizer, sold by Coulter, Inc. Mean volume weighted diameter is the sum of the mass of each particle times the diameter of a spherical particle of equal mass and density, divided by total particle mass. The toners must contain a thermoplastic binder in order to be fusible.

The polymers useful as toner binders in the practice of the present invention can be used alone or in combination and include those polymers conventionally employed in electrostatic toners. Useful polymers generally have a $T_g$ of from about 45° to 120° C., preferably from about 50° to 70° C. Preferably, toner particles prepared from these polymers have a relatively high caking temperature, for example, higher than about 60° C., so that the toner powders can be stored for relatively long periods of time at fairly high temperatures without having individual particles agglomerate and clump together. The fusing nip temperature preferably is within the range of from about 65° C. to about 200° C. so that the toner particles can readily be fused to the receiver to form a permanent image. Especially preferred polymers are those having a $T_g$ or melting temperature within the range of from about 45° to about 120° C.

Among the various polymers which can be employed in the toner particles of the present invention are polyethylenes, polypropylenes, polyisobutylenes, polyisopentylenes, polyfluoroolefins, such as polytetrafluoroethylene and polytrifluorochloroethylene, resin-modified maleic alkyd polymers, polyamides, phenol-formaldehyde polymers and various derivatives thereof, polyester condensates, modified alkyd polymers, aromatic polymers containing alternating methylene and aromatic units such as described in U.S. Pat. No. 3,809,554 and fusible crosslinked polymers and described in U.S. Pat. No. Re. 31,072.

Typical useful toner polymers include certain polycarbonates such as those described in U.S. Pat. No. 3,694,359, which include polycarbonate materials containing an alkylidene diarylene moiety in a recurring unit and having from 1 to about 10 carbon atoms in the alkyl moiety. Other useful polymers having the above-described physical properties include polymeric esters of acrylic and methacrylic acid such as poly(alkyl acrylate), and poly(alkyl methacrylate) wherein the alkyl moiety can contain from 1 to about 10 carbon atoms.

Additionally, other polyesters having the aforementioned physical properties also are useful. Among such other useful polyesters are copolyesters prepared from terephthalic acid (including substituted terephthalic acid), a bis(hydroxyalkoxy)phenylalkane having from 1 to 4 carbon atoms in the alkoxy radical and from 1 to 10 carbon atoms in the alkane moiety (which also can be a halogen-substituted alkane), and an alkylene glycol having from 1 to 4 carbon atoms in the alkylene moiety.

Other useful polymers are various styrene-containing polymers. Such polymers can comprise, e.g., a polymerized blend of from about 40 to about 100% by weight of styrene, from 0 to about 45% by weight of a lower alkyl acrylate or methacrylate having from 1 to about 4 carbon atoms in the alkyl moiety such as methyl, ethyl, isopropyl, butyl, etc. and from about 5 to about 50% by weight of another vinyl monomer other than styrene, for example, a higher alkyl acrylate or methacrylate having from about 6 to 20 or more carbon atoms in the alkyl group. Typical styrene-containing polymers prepared from a copolymerized blend as described hereinabove are copolymers prepared from a monomeric blend of 40 to 60% by weight styrene or styrene homolog, from about 20 to about 50% by weight of a lower alkyl acrylate or methacrylate and from about 5 to about 30% by weight of a higher alkyl acrylate or methacrylate such as ethylhexyl acrylate (e.g., styrene-butyl acrylate-ethylhexyl acrylate copolymer). Preferred fusible styrene copolymers are those which are covalently crosslinked with a small amount of a divinyl compound such as divinylbenzene. A variety of other useful styrene-containing toner materials are disclosed in U.S. Pat. Nos. 2,917,460, Re. 25,316, 2,788,288, 2,638,416, 2,618,552, and 2,659,670.

Useful toner particles can simply comprise the polymeric particles but it is often desirable to incorporate addenda in the toner such as waxes, colorants, release agents, charge control agents, and other toner addenda well known in the art. The toner particle also can incorporate carrier material so as to form what is sometimes referred to as a "single component developer." The toners can also contain magnetizable material, but such toners are not preferred because these magnetizable materials generally have color other than what is desired for the toner.

If a colorless image is desired, it is not necessary to add colorant to the toner particles. However, more usually a visibly colored image is desired and suitable colorants selected from a wide variety of dyes and pigments such as disclosed for example, in U.S. Pat. No. Re. 31,072 are used. A particularly useful colorant for toners to be used in black-and-white electrophotographic copying machines is carbon black. Colorants in the amount of about 1 to about 30 percent, by weight, based on the weight of the toner can be used. Often about 6 to 20 percent, by weight, of colorant is employed, depending upon toner particle size.

Charge control agents suitable for use in toners are disclosed for example in U.S. Pat. Nos. 3,893,935, 4,079,014, 4,323,634 and British Patent Nos. 1,501,065 and 1,420,839. Charge control agents are generally employed in small quantities such as about 0.01 to about 3, weight percent, often 0.1 to 1.5 weight percent, based on the weight of the toner.

Toners used in this invention can be mixed with a carrier vehicle. The carrier vehicles, which can be used to form suitable developer compositions, can be selected from a variety of materials. Such materials include carrier core particles and core particles overcoated with a thin layer of film-forming resin. Examples of suitable resins are described in U.S. Pat. Nos. 3,547,822, 3,632,512, 3,795,618, 3,898,170, 4,545,060, 4,478,925, 4,076,857, and 3,970,571.

The carrier core particles can comprise conductive, non-conductive, magnetic, or non-magnetic materials, examples of which are disclosed in U.S. Pat. Nos. 3,850,663 and 3,970,571. Especially useful in magnetic brush development schemes are iron particles such as porous iron particles having oxidized surfaces, steel particles, and other "hard" or "soft" ferromagnetic materials such as gamma ferric oxides or ferrites, such as ferrites of barium, strontium, lead, magnesium, or aluminum. See, for example, U.S. Pat. Nos. 4,042,518, 4,478,925, and 4,546,060.

The very small toner particles that are required in this invention can be prepared by a variety of processes well-known to those skilled in the art including spray-drying, grinding, and suspension polymerization, and the limited coalescence method of toner preparation described, for example, in U.S. Pat. Nos. 4,965,131 and 4,833,060.

The process of this invention is applicable to the formation of color copies. If a color copy is to be made, successive latent electrostatic images are formed on the element, each representing a different color, and each image is developed with a toner of a different color and is transferred to a receiver. Typically, but not necessarily, the images will correspond to each of the three primary colors, and black as a fourth color if desired. After each image has been transferred to the receiver, it can be fixed on the receiver, although it is preferable to fix all of the transferred images together in a single step. For example, light reflected from a color photograph to be copied can be passed through a filter before impinging on a charged photoconductor so that the latent electrostatic image on the photoconductor corresponds to the presence of yellow in the photograph. That latent image can be developed with a yellow toner and the developed image can be transferred to a receiver. Light reflected from the photograph can then be passed through another filter to form a latent electrostatic image on the photoconductor which corresponds to the presence of magenta in the photograph, and that latent image can then be developed with a magenta toner which can be transferred to the same receiver. The process can be repeated for cyan (and black, if desired) and then all of the toners on the receiver can be fixed in a single step.

Any conductive or nonconductive material can be used as the receiver, including various metals such as aluminum and copper and metal coated plastic films, as well as organic polymeric films and various types of paper. If a transparent polymeric receiver, such as polyethylene terephthalate, is used, good transparencies can be made using the process of this invention. Paper is the preferred receiver material because it is inexpensive and the high quality image produced by the process of this invention is most desirably viewed on paper. In order to achieve an acceptably high transfer efficiency and good image quality the receiver must have a roughness average in the transfer zone that is less than the diameter of the toner particles, where the roughness average is an indication of surface roughness, the value of which is the average height of the peaks in micrometers above the mean line between peaks and valleys. A suitable device to measure this value directly is a profilometer, such as the Surtronic 3 surface roughness instrument supplied by Rank Taylor Hobson, P.O. Box 36, Guthlaxton Street, Leicester LE205P England. The desired smoothness may most preferably be achieved by employing paper having the desired surface properties. Alternatively, it is possible to achieve the desired smoothness in the transfer zone by the application of heat, pressure or a combination of the two to paper which is not initially of the desired smoothness. Also see U.S. Pat. No. 4,737,433, herein incorporated by reference, which describes advantages to using a receiver surface that is smooth compared to toner particle size.

In order to insure that the toner adhesion to the receiver is greater than the toner adhesion to the element at the temperature of transfer, the properties of the receiver surface can also be selected so as to increase the adhesion of the toner particles to that surface. This can most advantageously be accomplished by coating the receiver with a thermoplastic polymer that will not stick to the photoconductive element, or by coating the receiver with a thermoplastic polymer over which is coated a release agent which preferably has a lower surface energy than said substrate, as is described in U.S. Pat. No. 4,968,578. The release agent coating should be in an amount sufficient to prevent the thermoplastic polymer from adhering to the element during transfer. Suitable thermoplastic polymers are those having a $T_g$ of 45° to 70° C. If a receiver is coated with a thermoplastic polymer, the receiver should be heated to a temperature above the $T_g$ of the thermoplastic polymer, so that the thermoplastic coating softens and the toner particles are transferred.

The image-bearing element from which the toner particles are transferred upon contact with the receiver can include any of the electrostatographic elements well known in the art. While dielectric recording materials can be used, photoconductive materials are preferred, and organic photoconductive materials are preferred over inorganic photoconductive materials, because they produce an image of superior quality. The surface properties of the element and the receiver should be adjusted so that at the operating temperature of the transfer the toner adhesion to the element surface is less than the toner adhesion to the receiver. This can be accomplished by using elements having low surface energy, such as polytetrafluoroethylene coated polyesters, or by incorporating low surface adhesion (LSA) materials into the substrate or coating the substrate with an LSA material. By "low surface energy" we mean a surface energy between 15 and 40 dynes/cm at 25° C. The method of the invention achieves particularly excellent toner transfer when a low surface energy photoconductive element is used.

The image-bearing element can be in the form of a drum, a belt, a sheet or other shape and can be a single use material or a reusable element. Reusable elements are preferred because they are generally less expensive. Of course, reusable elements must be thermally stable at the temperature of transfer for the duration of the transfer process.

In the practice of the method of the invention, the element is conventionally imaged. For example, an electrostatic latent image-charge pattern is formed on the photoconductive element which can consist of one or more photoconductive layers deposited on a conductive support. By treating the charge pattern with, or applying thereto, a dry developer containing charged toner particles, the latent image is developed. The toner pattern is then transferred to a receiver in accordance with the practice of the present invention and subsequently fused or fixed to the receiver.

Various types of photoconductive elements are known for use in electrophotographic imaging processes. In many conventional elements, the active photoconductive components are contained in a single layer composition. This composition is typically affixed, for example, to a conductive support during the electrophotographic imaging process.

Among the many different kinds of photoconductive compositions which may be employed in the typical single active layer photoconductive elements are inorganic photoconductive materials such as vacuum evaporated selenium, particulate zinc oxide dispersed in a polymeric binder, homogeneous organic photoconductive compositions composed of an organic photoconductor solubilized in a polymeric binder, and the like.

Other useful photoconductive insulating compositions which may be employed in a single active layer photoconductive element are the high-speed heterogeneous or aggregate photoconductive compositions described in U.S. Pat. No. 3,732,180. These aggregate-containing photoconductive compositions have a continuous electrically insulating polymer phase containing a finely-divided, particulate, co-crystalline complex of (i) at least one pyrylium-type dye salt and (ii) at least one polymer having an alkylidene diarylene group in a recurring unit.

In addition to the various single active layer photoconductive insulating elements such as those described above, various "multi-layer" photoconductive insulating elements have been described in the art. These kinds of elements are also referred to as "multi-active" or "multi-active-layer" photoconductive elements, have separate charge generation and charge transport layers as are appreciated by those familiar with the art. The configuration and principles of operation of multi-active photoconductive elements are known as are methods of their preparation having been described in a number of patents, for example, in U.S. Pat. Nos. 4,175,960, 4,111,693, and 4,578,334. Another configuration suitable for the imaging of elements in the practice of the process of the invention is the "inverted multi-layer" form in which a charge-transport layer is coated on the conductive substrate and a charge-generation layer is the surface layer. Examples of inverted multi-layer elements are disclosed, for example, in U.S. Pat. No. 4,175.960.

It should be understood that, in addition to the principal layers which have been discussed, i.e., the conductive substrate and the charge-generation and the charge-transport layers, the photoconductive elements which can be used in the practice of the present invention may also contain other layers of known utility, such as subbing layers to improve adhesion of contiguous layers and barrier layers to serve as an electrical barrier layer between the conductive layer and the photoconductive composition. The charge-generation and charge-transport layers also can contain other addenda such as leveling agents, surfactants and plasticizers to enhance various physical properties. In addition, addenda such as contrast control agents to modify the electrophotographic response of the element can be incorporated in the charge-transport layers.

A presently preferred photoconductive element is a near infrared sensitive inverted multi-layer photoconductive element made from fluorine-substituted titanyl tetrafluorophthalocyanine pigments which is disclosed in U.S. Pat. No. 4,701,396.

The invention is illustrated by the following examples.

In these examples, transfer was accomplished by simultaneously passing a thermoplastic polymeric coated receiver and an element, the surface of which had thereon a transferable toner image comprised of very fine toner particles through the nip region of a pair of hard compression rollers which were oppositely rotating with respect to each other, whereby the thermoplastic polymer coating on the receiver was contacted against the toner particles on the element surface while the thermoplastic polymer coating on the receiver was heated to a temperature sufficient to adhere the toner particles at their locations of contact to each other. Heating of the receiver was accomplished by heating the roller contacting the opposed face of the thermoplastic polymer coating, i.e., the substrate face or side of the receiver. The other roller, which contacted the opposed face of the element surface, i.e., the face or side of the element on which the toner particles were not carried, was at ambient temperature. Suitable contacting pressures were applied to the compression rollers during contact of the element and the receiver as they passed through the nip region created by the rollers. In these examples, the contacting pressures were applied to the compression rollers by means of two piston shafts in contact with and driving the unheated roller against the heated roller.

EXAMPLE 1

The following experiment was conducted at room temperature and 50% relative humidity. A photoconductive element comprising a non-low surface energy photoconductor of the type described in U.S. Pat. No. 4,701,396 to Hung et al., in a polyester binder, was charged using a positive corona. A step tablet containing various density patches was exposed onto the element surface through a negative. The latent electrostatic image was developed with a 3.6 micron latex limited coalescence toner using a small particle distribution developer brush. Transfer to a polyester overcoat receiver was accomplished by contacting the front (coated) surface of the receiver with the toner particles on the surface of the photoconductive element at a pressure of 16 pli. An electrostatic bias of 130 volts/micron was applied between the receiver and the photoconductive element. The back side of the receiver was heated to about 90° C. prior to the transfer. The process speed was 4 in./second. The receiver and the photoconductive element were separated immediately after transfer and prior to fixing.

The toner residue on the photoconductive element surface was then transferred in the same way to a separate polyester overcoat receiver. The reflection densities of uniform density patches on the first (transferred toner) receiver and of the second (residual toner) receiver were measured using a X-rite Model 312 densitometer with a status A filter. The experimental results are presented in FIG. 1, as described below.

COMPARATIVE EXAMPLE 1

For comparison purposes, the procedure of Example 1 was repeated, except that no electrostatic bias was applied between the element and the receiver.

As can be seen from FIG. 1, which illustrates residual reflection densities as a function of transferred reflection densities, significantly improved toner transfer was achieved using the electrostatically assisted thermal transfer method of the invention versus conventional non-electrostatically assisted thermal transfer.

EXAMPLE 2

The procedure of Example 1 was repeated, using a low surface energy photoconductive element of the type described in U.S. Pat. No. 4,772,526 to Kan et al. The experimental results are presented in FIG. 2, as described below.

COMPARATIVE EXAMPLE 2

For comparison purposes, the procedure of Example 2 was repeated, except that no electrostatic bias was applied between the element and the receiver.

Figure 2:
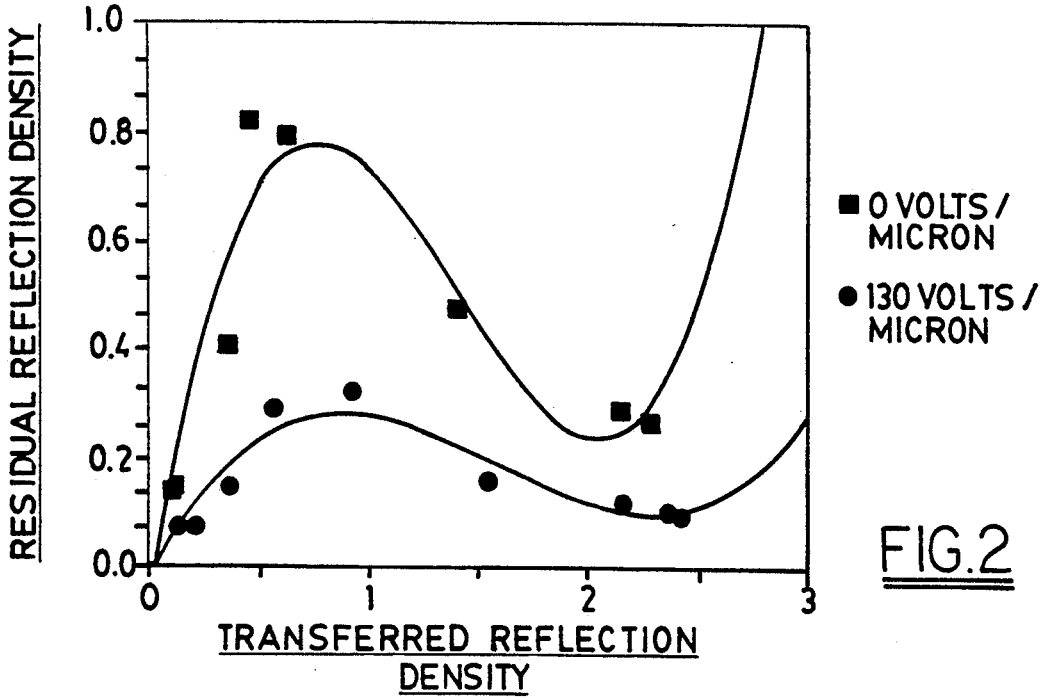
FIG. 2 is a graph of reflection density of residual (untransferred) toner as a function of reflection density of transferred toner in the absence and presence of an electric field using a low surface energy photoconductor.

FIG. 2, which is a plot of residual reflection densities as a function of transferred reflection densities, demonstrates the improved results obtained with the electrostatically assisted thermal transfer method of the invention versus the conventional thermal transfer method, when a low surface energy photoconductive element is used.

A comparison of FIGS. 1 and 2 also shows the added benefit obtained when a low surface energy photoconductive element is used.

The invention has been described in detail with particular reference to preferred embodiments thereof, but it will be understood that variations and modifications can be effected within the spirit and scope of the invention.

We claim:

1. A method of transferring electrostatically charged thermoplastic toner particles having a particle size less than 8 micrometers from an element having a surface to a receiver within a transfer zone, comprising:

heating said receiver;

contacting said heated receiver with said toner particles at a temperature sufficient to adhere said toner particles to one another at points of contact between said toner particles, but insufficient to cause said toner particles to flow into a single mass;

simultaneously establishing an electric field within said transfer zone tending to force said toner particles toward said receiver; and thereafter separating said receiver from said element.

2. A method according to claim 1, wherein said toner particles have a particle size of less than 5 micrometers.

3. A method according to claim 1, wherein said toner particles comprise a toner binder.

4. A method according to claim 3, wherein said toner binder has a $T_g$ of about 45° to 120° C.

5. A method according to claim 4, wherein said toner binder has a $T_g$ of about 50° to 70° C.

6. A method according to claim 1, wherein said receiver is transparent.

7. A method according to claim 1, wherein said receiver is paper having a roughness average in said transfer zone less than the diameter of said toner particles.

8. A method according to claim 1, wherein said receiver comprises a substrate; and a coating of a thermoplastic polymer on the surface of said substrate, wherein said thermoplastic polymer has a $T_g$ of 45° to 70° C.

9. A method according to claim 8, wherein said receiver further comprises a layer of a release agent on the surface of said coating in an amount sufficient to prevent said thermoplastic polymer from adhering to said element during said transferring.

10. A method according to claim 1, wherein said element is photoconductive.

11. A method according to claim 1, wherein said element comprises an organic photoconductor.

12. A method according to claim 1, wherein said element comprises a polyester binder.

13. A method according to claim 1, wherein said element is in the form of a drum.

14. A method according to claim 1, wherein said surface of said element has a surface energy of about 15 to 40 dynes/cm at 25° C.

15. A method according to claim 1, wherein said contacting is carried out at a pressure of about 2 to 40 pli.

16. A method according to claim 15, wherein said contacting is carried out at a pressure of about 8 to 30 pli.

17. A method according to claim 1, wherein said electric field has a field strength of 80 to 150 volts/micron.

18. A method according to claim 17, wherein said electric field has a field strength of 90 to 140 volts/micron.

19. A method of transferring electrostatically charged thermoplastic toner particles having a particle size less than 5 micrometers from an element to a receiver within a transfer zone, comprising:

heating said receiver;

contacting said heated receiver to said toner particles at a temperature sufficient to adhere said toner particles to one another at points of contact between said toner particles, but insufficient to cause said toner particles to flow into a single mass;

simultaneously establishing an electric field within said transfer zone tending to force said toner particles toward said receiver; and thereafter separating said receiver from said element; wherein said receiver is paper having a roughness average in said transfer zone less than the diameter of said toner particles, said surface of said element has a surface energy of 15 to 40 dynes/cm at 25° C., and said toner particles comprise a toner binder having a $T_g$ of about 50° to 70° C.

* * * * *